US007649509B2

(12) United States Patent
Chae

(10) Patent No.: US 7,649,509 B2
(45) Date of Patent: Jan. 19, 2010

(54) PLASMA DISPLAY DEVICE AND DRIVING METHOD THEREOF

(75) Inventor: Su-Yong Chae, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 671 days.

(21) Appl. No.: 11/301,371

(22) Filed: Dec. 12, 2005

(65) Prior Publication Data

US 2006/0256040 A1 Nov. 16, 2006

(30) Foreign Application Priority Data

May 10, 2005 (KR) ..... 10-2005-0038805

(51) Int. Cl.
*G09G 3/28* (2006.01)

(52) U.S. Cl. ..... 345/60; 345/61; 345/63; 345/55; 345/204

(58) Field of Classification Search ..... 345/60–61, 345/63, 55, 204
See application file for complete search history.

(56) References Cited

U.S. PATENT DOCUMENTS

| | | | |
|---|---|---|---|
| 6,714,250 | B1 | 3/2004 | Correa et al. |
| 6,731,255 | B1 | 5/2004 | Van Leeuwen et al. |
| 2003/0218581 | A1 | 11/2003 | Kawanami et al. |
| 2004/0160392 | A1 | 8/2004 | Kim et al. |
| 2004/0212563 | A1 | 10/2004 | Kang et al. |
| 2005/0122285 | A1 | 6/2005 | Kang et al. |

FOREIGN PATENT DOCUMENTS

| | | | |
|---|---|---|---|
| EP | 1 367 557 | A2 * | 12/2003 |
| EP | 1 657 699 | A1 | 5/2006 |
| EP | 1 657 700 | A1 | 5/2006 |
| JP | 09-244578 | | 9/1997 |
| JP | 2003-228321 | | 8/2003 |
| JP | 2003-288040 | | 10/2003 |
| JP | 2005-215670 | | 8/2005 |

OTHER PUBLICATIONS

European Search Report dated Dec. 4, 2006, for 05112466.7, in the name of Samsung SDI Co., Ltd.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A plasma display device and driving method. A plurality of subfields from one frame are divided into a first subfield group and a second subfield group. A first subfield and a second subfield having adjacent weights in the first subfield group each include a reset period for resetting the discharge cells, a first address period for selecting discharge cells in the first line group, a first sustain period for performing a sustain discharge, a second address period for selecting discharge cells in the second line group and a second sustain period for performing a sustain discharge.

17 Claims, 7 Drawing Sheets

FIG.7

| | G1' | | | | | | | | G2' | | | | | | | |
|---|---|---|---|---|---|---|---|---|---|---|---|---|---|---|---|---|
| Subfield no | SF1 | SF2 | SF3 | SF4 | SF5 | SF6 | SF7 | SF8 | SF1' | SF2' | SF3' | SF4' | SF5' | SF6' | SF7' | SF8' |
| Brightness weights | 1 | 2 | 4 | 8 | 16 | 32 | 64 | 128 | 1 | 2 | 4 | 8 | 16 | 32 | 64 | 128 |
| Grayscales | | | | | | | | | | | | | | | | |
| 0 | | | | | | | | | | | | | | | | |
| 1 | ○ | | | | | | | | △ | | | | | | | |
| 2 | | △ | | | | | | | | ○ | | | | | | |
| 3 | ○ | △ | | | | | | | △ | ○ | | | | | | |
| 4 | | | ○ | | | | | | | | △ | | | | | |
| 5 | ○ | | ○ | | | | | | △ | | △ | | | | | |
| 6 | | △ | ○ | | | | | | | ○ | △ | | | | | |
| 7 | ○ | △ | ○ | | | | | | △ | ○ | △ | | | | | |
| 8 | | | | △ | | | | | | | | ○ | | | | |
| 9 | ○ | | | △ | | | | | △ | | | ○ | | | | |
| 10 | | △ | | △ | | | | | | ○ | | ○ | | | | |

○ : Selected grayscale portion for odd line

△ : Selected grayscale portion for even line

PLASMA DISPLAY DEVICE AND DRIVING METHOD THEREOF

CROSS-REFERENCE TO RELATED APPLICATION

This application claims priority to and the benefit of Korean Patent Application No. 10-2005-0038805 filed in the Korean Intellectual Property Office on May 10, 2005, the entire contents of which are incorporated herein by reference.

BACKGROUND (a) Field of the Invention

The embodiments of the present invention relate to a plasma display device and a driving method thereof. Specifically, embodiments of the present invention relate to a plasma display device for reducing flicker and a driving method thereof.

(b) Description of the Related Art

Flat panel displays such as liquid crystal display devices (LCDs), field emission displays (FEDs) and plasma display devices are actively being developed. Plasma display devices in flat panel displays have better brightness, luminescent efficiency and wider viewing angles in comparison to other types of flat panel displays. Therefore, plasma displays have been focused on as substitutes for the conventional cathode ray tubes (CRTs) in large display devices such as display devices that are greater than 40 inches in size.

A direct current (DC) plasma display device has electrodes that are exposed to a discharge space without insulation, thereby causing a current to directly flow through the discharge space during the application of a voltage to the electrodes. Therefore, a problem with such a DC plasma display device (PDP) is that it requires a resistance for limiting the current. On the other hand, an alternating current (AC) plasma display device has electrodes that are covered with a dielectric layer, which forms a natural capacitance component that restricts the current and protects the electrodes from the impact of ions during discharge. As a result, the AC plasma display device has an advantage over the DC plasma display device because it has a longer lifetime.

As shown in FIG. 1, the above-noted plasma display device divides one frame of an input video signal data into a plurality of subfields and combines the subfields to express grayscale levels. Each subfield has a reset period, an address period and a sustain period. The reset period is for initializing the status of each discharge cell so as to facilitate an addressing operation on the discharge cell. The address period is for applying an address voltage to cells to be turned-on (i.e., addressed cells) to accumulate wall charges in these cells. Cells that do not have the address voltage applied to them are not selected to be turned-on cells. The sustain period is for applying a sustain discharge pulse or set of pulses to perform a discharge for displaying images via the turned-on cells selected during the address period.

FIG. 1 illustrates one frame that is divided into eight subfields to express 256 different grayscale levels. Each subfield (SF1-SF8) includes reset periods (not shown), address periods (A1-A8) and sustain periods (S1-S8). The sustain periods (S1-S8) have emission periods with durations of 1T, 2T, 4T, . . . , 128T where T is a unit of time. The emission periods have different individual durations with the combined ratio of 1:2:4:8:16:32:64:128.

For example, a grayscale level of 3 is expressed by discharging a discharge cell during a first subfield (SF1) having an emission period with a duration of 1T and a second subfield (SF2) having an emission period with a duration of 2T so as to have a total emission period with a duration of 3T. In this way, a combination of different subfields, each having different emission periods, produces pictures having 256 different grayscale levels.

Expression of grayscale levels by the plasma display device generates flicker that is detectable by human vision. The flicker is more easily detected when the screen size becomes larger or its refresh frequency is low. A plasma display device generates a large amount of flicker when generating phase alternation line (PAL) images when the two above-noted conditions are present. In this case, the flicker can only be reduced by controlling (i.e. increasing) the frequency, because the screen size cannot be modified.

As shown in FIG. 2, subfields of one frame are divided into two groups, G1 and G2, each with the same arrangement of subfield weights except that the least significant bit (LSB) subfield in each group differs. This scheme reduces flicker that is generated by a large screen plasma display device that uses 50 Hz video signals. This scheme is more efficient in reducing flicker than the conventional arrangements of subfields such as the minimum increment arrangement or the minimum decrement arrangement. However, the scheme shown in FIG. 2 may generate flicker at specific grayscale levels because it cannot divide the amount of emitted light into two equal smaller amounts.

SUMMARY

The embodiments of the present invention provide a plasma display device and a driving method thereof having the feature of reduced flicker.

An example embodiment of a driving method for a plasma display device divides a frame into a plurality of subfields, divides the subfields into a first group and a second group and drives the subfields. The plurality of discharge cells in the plasma display panel may be divided into a first line group and a second line group. In one embodiment, a first subfield has a sustain period with a first weight and a second subfield has a sustain period with a second weight that is greater than the first weight of the first subfield. The weight of the second subfield is adjacent to the weight of the first subfield in the order of the weights for the first subfield group. In a time period for the first and second subfields the discharge cells are reset, the discharge cells corresponding to the first line group are addressed and a first sustain discharge is generated and discharge cells corresponding to the second line group are addressed and a second sustain discharge is generated. A third subfield has a third weight and a fourth subfield has a fourth weight that is greater than the third weight and is adjacent to the third weight in the order of the weights of the second subfield group. In a time period for the third and fourth subfields, the discharge cells are reset, the discharge cells corresponding to the second line group are addressed and a third sustain discharge is generated. Discharge cells corresponding to the first line group are addressed and a fourth sustain discharge is generated.

A second sustain discharge is generated in the discharge cells addressed in first line group and the discharge cells addressed in the second line group during the first and second subfields. The fourth sustain discharge is generated in the discharge cell addressed in second line group and the discharge cell addressed in first line group during the third and fourth subfields. The first line group may be an even line group and the second line group may be an odd line group.

The number of sustain pulses applied in the first sustain discharge may correspond to the number of sustain pulses applied in the second sustain discharge, and the number of sustain pulses applied in the third sustain discharge may correspond to the number of sustain pulses applied in the fourth sustain discharge.

In one embodiment, a plasma display device includes a plasma display panel (PDP), a controller and a driver. The PDP includes a plurality of discharge cells wherein scan lines of discharge cells are divided into a first line group and a second line group and are then driven. The controller divides a frame into a plurality of subfields and divides the subfields into a first subfield group and a second subfield group. The drivers drive the PDP according to control signals received from the controller. A first subfield and a second subfield in the first subfield group have adjacent weights and include a reset period, a first address period, a first sustain period, a second address period and a second sustain period. The reset period is for resetting the discharge cells. The first address period is for selecting discharge cells to be selected from among the discharge cells corresponding to the first line group. The first sustain period is for performing a sustain discharge. The second address period is for selecting discharge cells to be selected from among the discharge cells corresponding to the second line group. The second sustain period is for performing a sustain discharge. A third subfield and a fourth subfield in the second subfield group have adjacent weights and include a reset period, a third address period, a third sustain period, a fourth address period and a fourth sustain period. The reset period is for resetting the discharge cells. The third address period is for selecting discharge cells in the second line group. The third sustain period is for performing a sustain discharge. The fourth address period is for selecting discharge cells in the first line group. The fourth sustain period is for performing a sustain discharge.

In one embodiment, the discharge cells selected in the first address period and the second address period are sustain discharged during the second sustain period and the discharge cells selected in the third address period and the fourth address period are sustain discharged in the fourth sustain period.

The number of sustain pulses applied in the first sustain period corresponds to the number of sustain pulses applied in the second sustain period. The number of sustain pulses applied in the third sustain period corresponds to the number of sustain pulses applied in the second sustain period.

In one embodiment, the value of the weight allocated to the second subfield is twice the value of the weight allocated to the first subfield. The value of the weight allocated to the fourth subfield is twice the value of the weight allocated to the third subfield. In one embodiment, the first line group may be an even line group and the second line group may be an odd line group.

In a further embodiment, a driving method of a plasma display device divides a frame into a plurality of subfields, divides the subfields into groups having at least a first group and a second group and drives the subfields.

Scan lines for the plurality of discharge cells may be divided into a first line group and a second line group. In a first subfield having a first weight and a second subfield having a second weight that is greater than the first weight and is adjacent to the first weight from among the weights of the first subfield group, the discharge cells are reset, discharge cells corresponding to the first line group are addressed, a first sustain discharge is generated, discharge cells corresponding to the second line group are addressed and a second sustain discharge is generated.

The second weight may be twice the first weight and the number of sustain discharges generated by the first sustain discharge corresponds to the number of sustain discharges generated by the second sustain discharge.

BRIEF DESCRIPTION OF THE DRAWINGS

FIG. 7 shows a grayscale table for the subfield arrangement and driving method according to an exemplary embodiment of the present invention.

DETAILED DESCRIPTION

Figure 3:
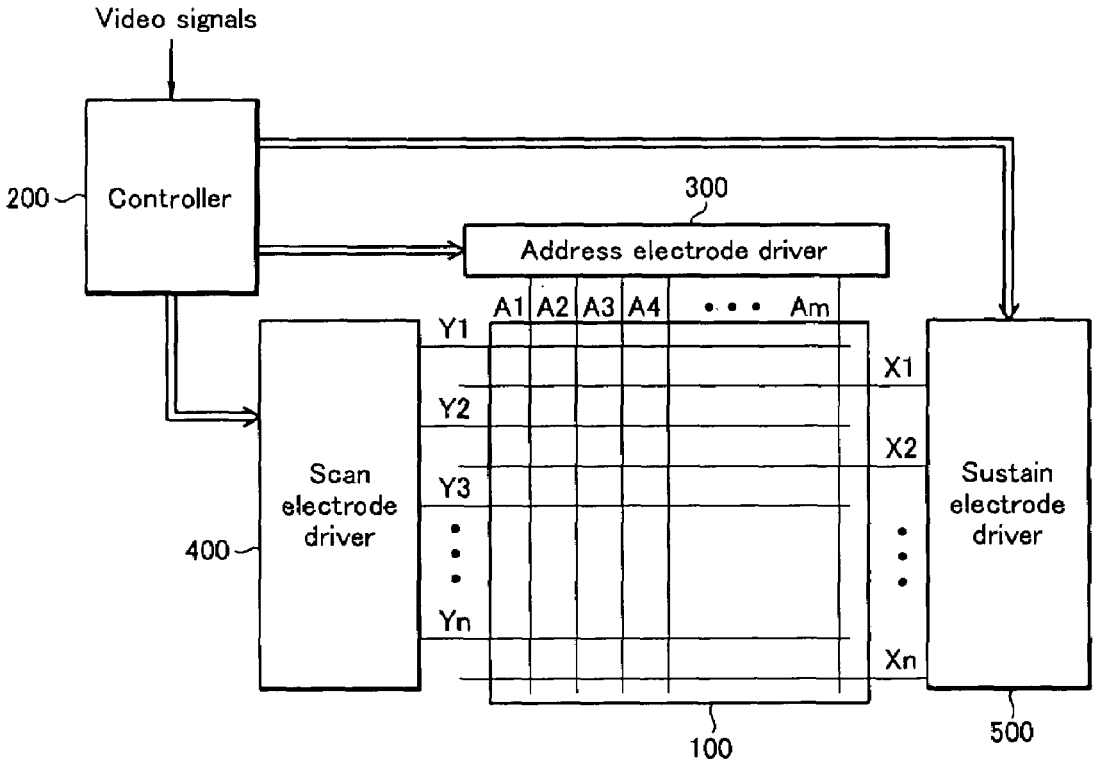
FIG. 3 shows a top plan view of a plasma display device according to an exemplary embodiment of the present invention.

FIG. 3 shows a top plan view of a plasma display device according to an exemplary embodiment of the present invention. The plasma display device includes a plasma display panel (PDP) 100, a controller 200, an address electrode driver 300, a scan electrode driver 400 and a sustain electrode driver 500.

The PDP 100 includes a plurality of address electrodes A1 to Am in the column direction and a plurality of sustain electrodes X1 to Xn and scan electrodes Y1 to Yn in the row direction. The sustain electrodes X1 to Xn are formed to correspond to the scan electrodes Y1 to Yn and their first terminals are coupled in common with each other. In addition, the PDP 100 includes a substrate (not shown) on which the sustain and scan electrodes X1 to Xn and Y1 to Yn are arranged and a substrate (not shown) on which the address electrode A1 to Am are arranged. The two substrates face each other with a gap between them so that the scan electrodes Y1 to Yn and sustain electrodes X1 to Xn each cross the address electrodes A1 to Am. Discharge spaces are present at crossing regions of the address electrodes A1 to Am and the sustain and scan electrodes X1 to Xn and Y1 to Yn. These elements combine to form discharge cells. The above-described PDP 100 shows one embodiment of the present invention, however the driving method may be applied to other types and configurations of panels.

In one embodiment, the controller 200 may receive an external video signal and output an address electrode driving control signal, a sustain electrode driving control signal and a scan electrode driving control signal. In addition, the controller 200 divides one frame into a plurality of subfields and drives the subfields. In this instance, the controller 200 divides a plurality of subfields into two groups and provides the same subfield weight scheme to subfields of both groups so as to suppress the generation of flicker. The lines of discharge cells, which correspond to horizontal lines following the scan electrodes Y1 to Yn are driven in the respective subfields according to a sorting of the lines into odd lines or even lines. The odd lines and the even lines are alternately driven according to the arranged order of subfields.

The address electrode driver 300 receives an address electrode driving control signal from the controller 200 and applies a display data signal for selecting a discharge cell to be displayed to the appropriate address electrodes. The scan electrode driver 400 receives a scan electrode driving control signal from the controller 200 and applies a driving voltage to the scan electrodes. The sustain electrode driver 500 receives a sustain electrode driving control signal from the controller 200 and applies a driving voltage to the sustain electrodes.

A method for arranging subfield weights for reducing flicker and driving a plasma display device according to an exemplary embodiment of the present invention will now be described with reference to FIG. 4 through FIG. 7.

Figure 4:
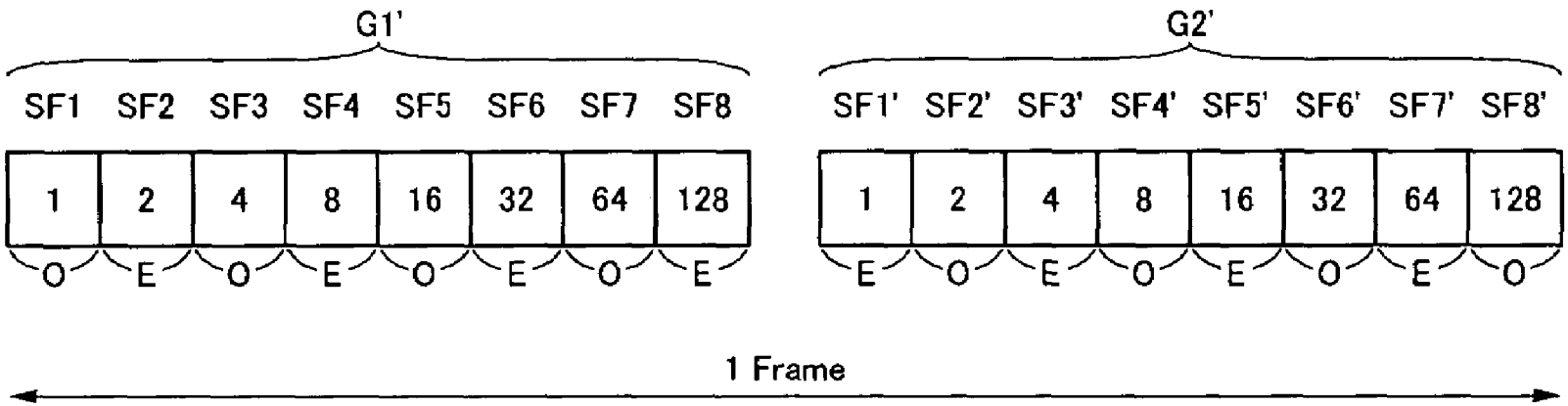
FIG. 4 shows an arrangement of subfield weight values according to an exemplary embodiment of the present invention.

FIG. 4 shows an arrangement of subfield weight values according to an exemplary embodiment of the present invention. The Arabic numbers in FIG. 4 represent weights of the respective subfields (SF1, SF2 . . . SF1', SF2' . . . SF8').

The arrangement of subfield weights of one frame is divided between two subfield groups G1' and G2'. The subfields in each of the subfield groups G1' and G2' have identical weights. The subfield weights of the first subfield group G1' are arranged in the order of {1 SF1, 2 SF2, 4 SF3, 8 SF4, 16 SF5, 32 SF6, 64 SF7, 128 SF8} and the subfield weights of the second subfield group G2' are arranged in the order of {1(SF1'), 2(SF2'), 4(SF3'), 8(SF4'), 16(SF5'), 32(SF6'), 64(SF7'), 128(SF8')}. Subfield weights in each of the two subfield groups G1' and G2' are the same, for example, a subfield weight of 1 allocated to the subfield SF1 of the first subfield group G1' corresponds to the subfield weight of 1 allocated to the subfield SF1' of the second subfield group G2'. In one embodiment, the subfields SF2, SF4, SF6, and SF8 of the first subfield group G1' address and drive even lines (labeled as 'E' in FIG. 4), and the subfields SF1, SF3, SF5, and SF7 address and drive odd lines (labeled as 'O' in FIG. 4). In addition, the subfields SF1', SF3', SF5', and SF7' of the second subfield group G2' address and drive even lines (labeled as 'E' in FIG. 4), and the subfields SF2', SF4', SF6', and SF8' address and drive odd lines (labeled as 'O' in FIG. 4). In the subfields having the same weight in each of the two groups G1' and G2', one of the subfields addresses and drives odd lines and the other one of the subfields addresses and drives even lines. The subfields of the first subfield group G1' alternately address and drive odd lines and even lines according to the order of the subfields. The subfields of the second subfield group G2' also alternately address and drive even lines and odd lines according to the order of the subfields. In another embodiment, differing from FIG. 4, the order of the odd lines and even lines addressed in the subfield of the first subfield group G1' may be changed. The order between the odd lines and even lines addressed in the subfield of the second subfield group G2' may also be changed.

The number of subfields shown in FIG. 4 is sixteen, however, sixteen is greater than the conventional number of subfields for a frame. In one embodiment, the reset period is doubled compared to the conventional reset period. The sustain period may be relatively reduced and the brightness of the panel accordingly diminished in comparison with a conventional panel.

A method for sharing a reset period between two subfields and driving the subfields is described with reference to FIG. 5. The two subfields have a reset period R, an even-line address period $A_E$, a first sustain period $S_1$, an odd-line address period $A_O$ and a second sustain period $S_2$. In one embodiment, the same size and duration of sustain pulse is applied in the two sustain periods $S_1$ and $S_2$ such that each has same weight of n.

In the reset period R, discharge cells are reset to be ready to be addressed. In the even line address period $A_E$, address discharges are generated on the even lines to perform an address operation. In the first sustain period $S_1$, cells selected during the address period $A_E$ are sustain-discharged to represent the weight of n. After the first sustain period $S_1$, the odd line address period $A_O$ is provided without a reset period. During the odd line address period $A_O$, address discharges are generated at the odd lines to perform an address operation. In this embodiment, a sustain pulse corresponding to the weight of n is applied during the second sustain period $S_2$. During the second sustain period $S_2$, even lines addressed in the even line address period $A_O$ and sustain-discharged during the first sustain period $S_1$ are again sustain-discharged in addition to the odd lines that are addressed during the odd line address period $A_O$. Therefore, sustain pulses corresponding to the weight of n are applied in the first sustain period $S_1$ and the second sustain period $S_2$. The even lines are expressed with the weight of 2n and the odd lines are expressed with the weight of n. Accordingly, consecutive subfields may be realized using a single reset period. The method for implementing the reset period R, the even line address period $A_E$, the first sustain period $S_1$, the odd line address period $A_O$, and the second sustain period $S_2$ would be understood by a person skilled in the art.

In one embodiment, the method described with reference to FIG. 5 may be applied to consecutive first and second subfields SF1 and SF2 in the first subfield group G1'. Sustain pulses corresponding to the weight of 1 may be applied in the first sustain period $S_1$ and the second sustain period $S_2$. The sustain discharge may be generated on the even lines during the first sustain period $S_1$ and during the second sustain period $S_2$ to express the second subfield SF2 having the weight of 2. The sustain discharge is generated on the odd lines during the second sustain period $S_2$ to express the first subfield SF1 having the weight of 1. In a like manner, the weight of 4 may be allocated to the consecutive third and fourth subfields SF3 and SF4 of the first subfield group G1' through the use of a proportionate duration in the first sustain period $S_1$ and the second sustain period $S_2$. The weight of 16 is allocated to the fifth subfield SF5 and the sixth subfield SF6 through the use of a proportionate duration in the first sustain period $S_1$ and the second sustain period $S_2$. The weight of 64 is allocated to the seventh subfield SF7 and the eighth subfield SF8 through the use of a proportionate duration in the first sustain period $S_1$ and the second sustain period $S_2$. In addition, the subfields of the second subfield group G2' may be implemented by changing the addressing order between the even lines and the odd lines of FIG. 5. The periods may be arranged to be in the order of the reset period R, the odd line address period $A_O$, the first sustain period $S_1$, the even line address period $A_E$, and then the second sustain period $S_2$. The weight of n is implemented through the sustain periods in a manner similar to the first subfield group G1'.

Figure 5:
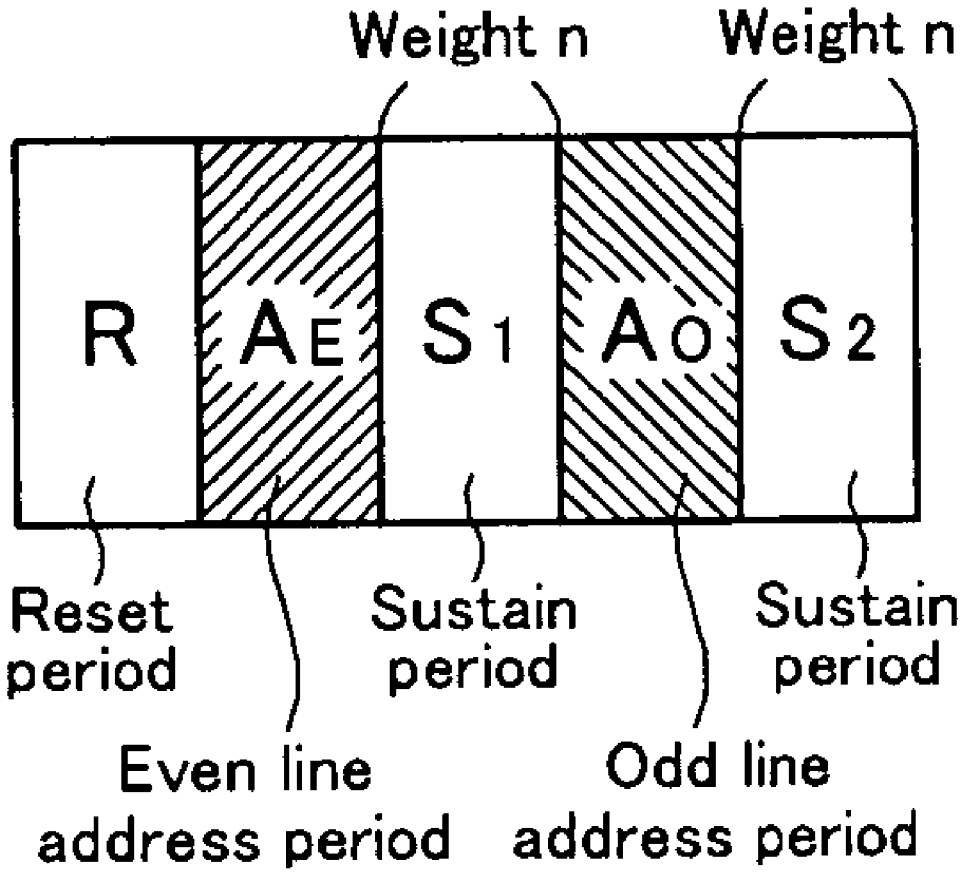
FIG. 5 shows a method for driving two consecutive subfields in a single reset period.
Figure 6:
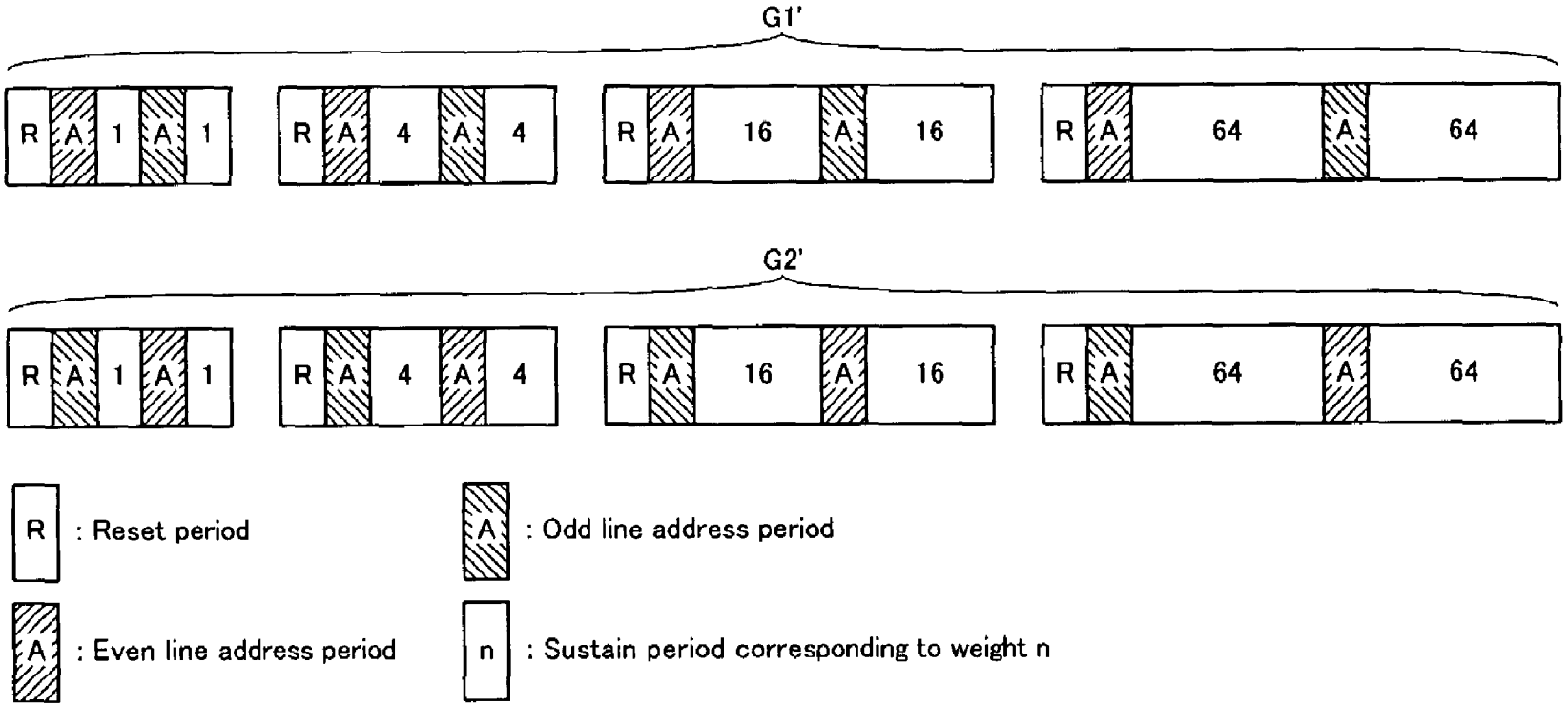
FIG. 6 shows a case for applying the method of FIG. 5 to the subfields of FIG. 4.

FIG. 6 shows an embodiment applying the method of FIG. 5 to the subfields of FIG. 4. The even line address period is provided in advance of the odd line address period and after the reset periods of the first subfield group G1'. The odd line address period is provided in advance of the even line address period and after the reset periods of the second subfield group G2'. In addition, when consecutive subfields have a single reset period R, the weight allocated during the two sustain periods corresponds to the weight allocated to the entire subfield.

FIG. 7 shows a grayscale table for the subfield arrangement and driving method according to one exemplary embodiment of the present invention. FIG. 7 shows a grayscale table for predetermined grayscale levels for ease of description.

In one example the first subfield SF1 of the first subfield group G1' may be selected to express the grayscale level of 1 in a discharge cell on an odd line and the first subfield SF1' of the second subfield group G2' may be selected to express the grayscale level of 1 in a discharge cell on an even line. In another example, the first subfield SF1 of the first subfield group G1' and the second subfield SF2' of the second subfield group G2' may be selected to express the grayscale level of 3 in a discharge cell on an odd line. The second subfield SF2 of the first subfield group G1' and the first subfield SF1' of the second subfield group G2' may be selected to express the grayscale level of 3 in a discharge cell on an even line. Referring to FIG. 7, when the same grayscale level is expressed on odd lines and even lines, light emits at the same point relative to time during the first subfield group G1' and during the second subfield group G2'.

Figure 8:
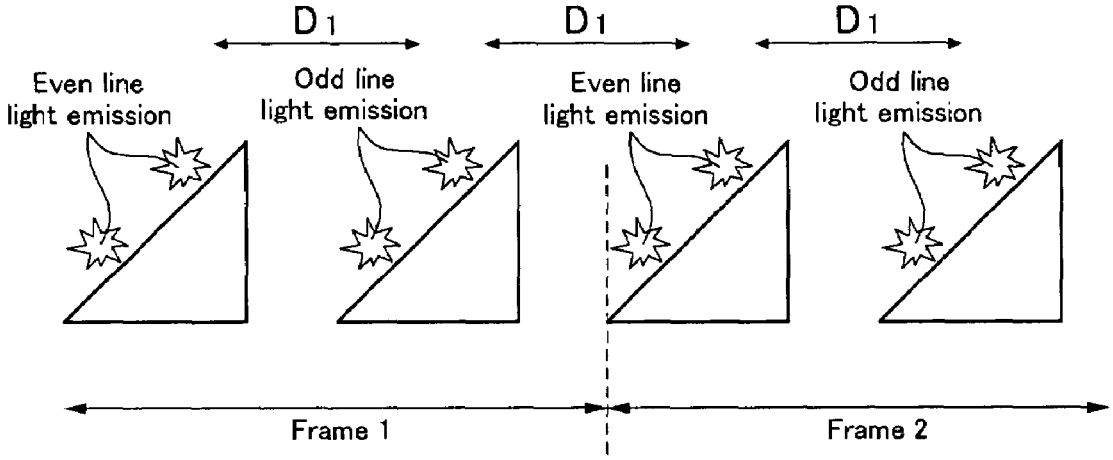
FIG. 8 shows light emission points when a grayscale level of 10 is expressed in an even-line discharge cell and when a grayscale level of 10 is expressed in an odd-line discharge cell.

FIG. 8 shows light emission points for one embodiment when the grayscale level of 10 is expressed in an even-line discharge cell and when the grayscale of 10 is expressed in an odd-line discharge cell. Referring to FIG. 7, light emits during the second subfield SF2 and the fourth subfield SF4 of the first subfield group G1' when the grayscale of 10 is expressed at a discharge cell on an even line. Light emits during the second subfield SF2' and the fourth subfield SF4' of the second subfield group G2' when the grayscale level of 10 is expressed at a discharge cell on an odd line. Accordingly, light emits at the point shown in FIG. 8, specifically, the light emits at the same point in the first subfield group G1' and the second subfield group G2'. Further, light emits at the same point of the two subfield groups G1' and G2' when the same grayscale level is expressed on an odd line and an even line for all grayscale levels. The driving method of the plasma display device according to one embodiment of the present invention produces a driving efficiency equivalent to 100 Hz, because the odd lines and the even lines that are adjacent to each other and displaying very similar grayscale levels generate a reduced amount of flicker.

Figure 1:
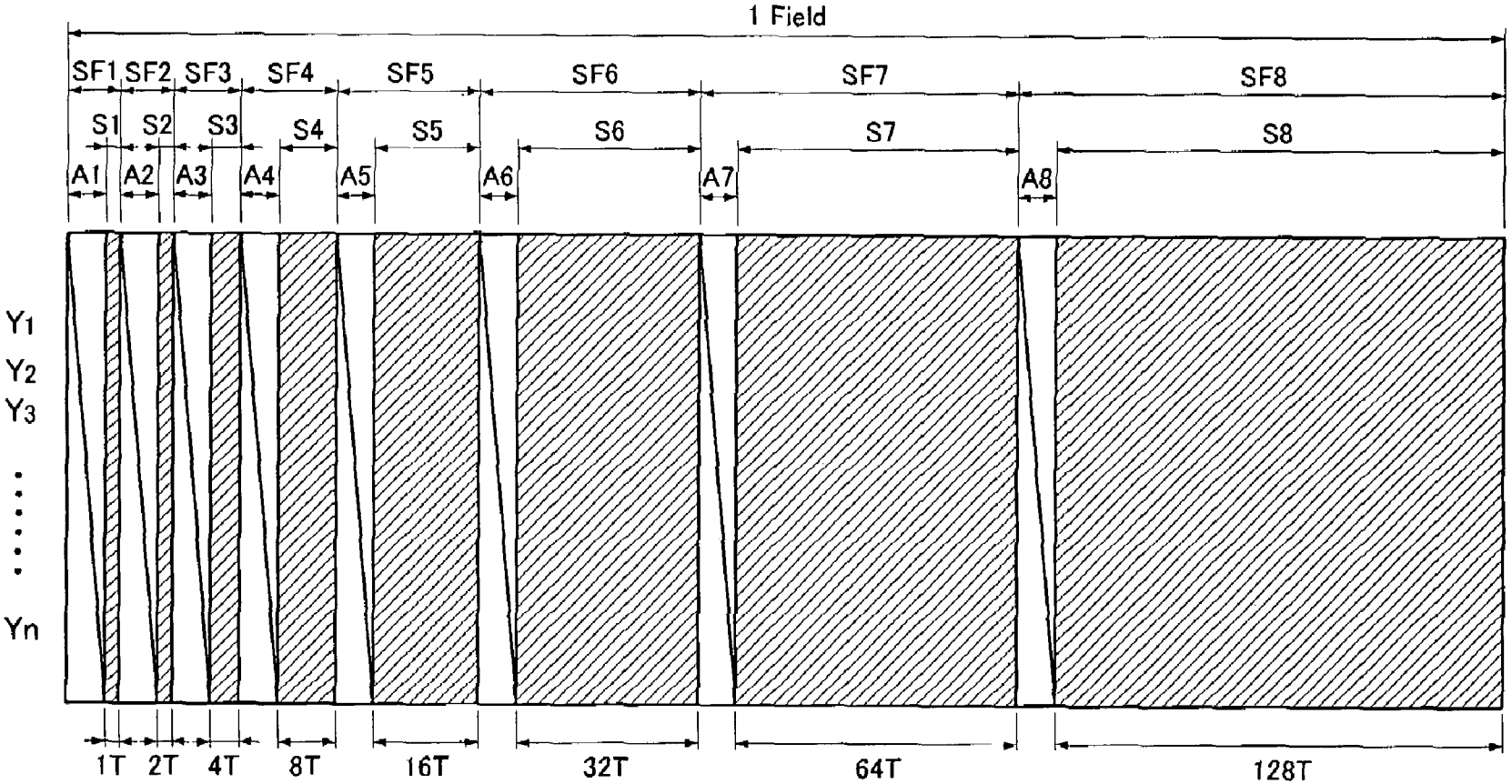
FIG.1 (Prior Art)
FIG. 1 shows a conventional grayscale display method of a plasma display device.
Figure 2:
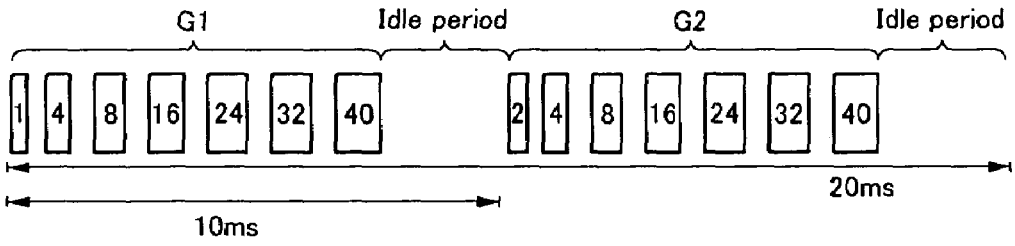
FIG.2 (Prior Art)
FIG. 2 shows a conventional arrangement of subfield weight values.

A time duration of the two subfield groups of one frame will now be described comparing the driving method according to the embodiments of the present invention with the conventional driving method of FIG. 2. For this example, it is assumed that a duration of a reset period, a duration of an address period, and a duration of a sustain pulse with a weight of 1 in the sustain period are given to be Rt, At, and St, respectively. Referring to FIG. 2, the duration of the two subfield groups G1 and G2 is calculated to be 14*Rt+14*At+251St because each subfield has a reset period, an address period and a sustain period. The address period shown in FIG. 6 is divided into an even line address period and an odd line address period and the time of At/2 is required for each. Therefore, the duration of the driving method according to an exemplary embodiment of the present invention is calculated to be 8*Rt+(At/2)*16+340St. Compared to the prior art, the duration of a frame is reduced by six reset periods (6Rt) and six address periods (6At), and therefore, the increase in duration caused by increasing the sustain period from 240St to 360St is not a significant problem. For example, when it is given that Rt=300 μs, At=800 μs, and St=5 μs, the prior art generates a duration time of 14*Rt+14*At+251St=16655 μs and the driving method according to an exemplary embodiment of the present invention generates a duration time of 8*Rt+(At/2)*16+340St=10500 μs. Therefore, the method according to an embodiment of the present invention reduces the number of reset periods and address periods to reduce the total frame duration time. As a result brightness may be improved or subfields added through the addition of a sustain period allowed by the reduction of the total frame duration time.

Methods for dividing the discharge cells on horizontal lines into odd lines and even lines and driving the same according to the embodiments of the present invention has been described. The embodiments may also be applicable to other methods for dividing the horizontal lines of discharge cells, for example, the lines may be divided into a top portion and a bottom portion or similar organization of discharge cells.

As described above, the generation of flicker may be reduced by controlling the panel to emit light at the same point in subfields of two groups for a predetermined grayscale level. In addition, brightness may be increased or the number of subfields may be increased by reducing the duration time of the subfields of the two groups, which form a single frame.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A driving method for a plasma display device, wherein a frame is divided into a plurality of subfields, the plurality of subfields being divided into a first subfield group and a second subfield group and the plurality of subfields being driven, and wherein scan lines defining a plurality of discharge cells are divided into a first line group and a second line group, the first subfield group comprising first subfield having a first weight and a second subfield having a second weight that is greater than the first weight and is adjacent to the first weight in an order of weights of the first subfield group, the second subfield group comprising a third subfield having a third weight and a fourth subfield having a fourth weight that is greater than the third weight and is adjacent to the third weight in an order of weights of the second subfield group, the driving method comprising:

resetting the plurality of discharge cells a first time during a first time period, the first time period comprising a single reset period;

addressing discharge cells corresponding to the first line group of the plurality of discharge cells during a first address period of the first time period;

after the first address period, generating a first sustain discharge during a first sustain period of the first time period;

after the first sustain period, addressing discharge cells corresponding to the second line group of the plurality of discharge cells during a second address period of the first time period;

after the second address period, generating a second sustain discharge during a second sustain period of the first time period;

resetting the plurality of discharge cells during a second time period, the second time period comprising a single reset period;

addressing the discharge cells corresponding to the second line group of the plurality of discharge cells during a third address period of the second time period, after the third address period, generating a third sustain discharge during a third sustain period of second time period;

after the third sustain period, addressing the discharge cells corresponding to the first line group of the plurality of discharge cells during a fourth address period of the second time period; and after the fourth address period, generating a fourth sustain discharge during a fourth sustain period of the second time period.

2. The driving method of claim 1, wherein the second sustain discharge is generated in the discharge cells corresponding to the first line group and the second line group addressed during the first time period.

3. The driving method of claim 2, wherein the fourth sustain discharge is generated in the discharge cells corresponding to the first line group and the second line group addressed during the second time period.

4. The driving method of claim 1, wherein the first line group is an even line group and the second line group is an odd line group.

5. The driving method of claim 1, wherein the value of the first weight corresponds to the value of the third weight and the value of the second weight corresponds to the value of the fourth weight.

6. The driving method of claim 1, wherein a number of sustain pulses applied in the first sustain discharge corresponds to a number of sustain pulses applied in the second sustain discharge and a number of sustain pulses applied in the third sustain discharge corresponds to a number of sustain pulses applied in the fourth sustain discharge.

7. The driving method of claim 5, wherein a number of sustain pulses applied in the first sustain discharge corresponds to a number of sustain pulses applied in the fourth sustain discharge.

8. The driving method of claim 1, wherein the value of the second weight is twice the value of the first weight and the value of the fourth weight is twice the value of the third weight.

9. The driving method of claim 1, wherein a number of subfields included in the first subfield group corresponds to a number of subfields included in the second subfield group and weights of subfields included in the first subfield group correspond to weights of subfields included in the second subfield group.

10. A plasma display device comprising:

a plasma display panel comprising a plurality of discharge cells arranged in lines of discharge cells, wherein the lines of discharge cells are divided into a first line group and a second line group;

a controller adapted to divide a frame into a plurality of subfields and adapted to divide the plurality of subfields into a first subfield group and a second subfield group; and a driver adapted to drive the plasma display panel according to a control signal generated by the controller, wherein a first subfield and a second subfield having adjacent weights in the first subfield group comprise a single reset period for resetting the discharge cells, a first address period for selecting discharge cells in the first line group, a first sustain period after the first address period for performing a sustain discharge, a second address period after the first sustain period for selecting discharge cells in the second line group and a second sustain period after the second address period for performing a sustain discharge, and wherein a third subfield and a fourth subfield having adjacent weights in the second subfield group comprise a single reset period for resetting the discharge cells, a third address period for selecting the discharge cells in the second line group, a third sustain period after the third address period for performing a sustain discharge, a fourth address period after the third sustain period for selecting the discharge cells in the first line group and a fourth sustain period after the fourth address period for performing a sustain discharge.

11. The plasma display device of claim 10, wherein the discharge cells selected in the first address period and the discharge cells selected in the second address period are sustain discharged in the second sustain period, and wherein the discharge cells selected in the third address period and the discharge cells selected in the fourth address period are sustain discharged in the fourth sustain period.

12. The plasma display device of claim 10, wherein a number of sustain pulses applied in the first sustain period corresponds to a number of sustain pulses applied in the second sustain period, and wherein a number of sustain pulses applied in the third sustain period corresponds to a number of sustain pulses applied in the fourth sustain period.

13. The plasma display device of claim 10, wherein a value of a weight allocated to the first subfield corresponds to a value of a weight allocated to the third subfield and a value of a weight allocated to the second subfield corresponds to a value of a weight allocated to die fourth subfield.

14. The plasma display device of claim 13, wherein a number of sustain pulses applied in the first sustain period and a number of sustain pulses applied in the fourth sustain period correspond to each other.

15. The plasma display device of claim 10, wherein a value of a weight allocated to the second subfield is twice a value of a weight allocated to the first subfield and a value of a weight allocated to the fourth subfield is twice a value of a weight allocated to the third subfield.

16. The plasma display device of claim 10, wherein a number of subfields included in the first subfield group corresponds to a number of subfields included in the second subfield group and weights of subfields included in the first subfield group correspond to weights of subfields included in the second subfield group.

17. The plasma display device of claim 10, wherein the first line group is an even line group and the second line group is an odd line group.

* * * * *

UNITED STATES PATENT AND TRADEMARK OFFICE

CERTIFICATE OF CORRECTION

PATENT NO. : 7,649,509 B2
APPLICATION NO. : 11/301371
DATED : January 19, 2010
INVENTOR(S) : Su-Yong Chae It is certified that error appears in the above-identified patent and that said Letters Patent is hereby corrected as shown below:

| | |
|---|---|
| Column 8, Claim 1, line 32 | After "comprising"<br>Insert -- a -- |
| Column 8, Claim 1, line 65 | After "of"<br>Insert -- the -- |
| Column 10, Claim 13, line 37 | Delete "die"<br>Insert -- the -- |

Signed and Sealed this
Twelfth Day of April, 2011

David J. Kappos

David J. Kappos
*Director of the United States Patent and Trademark Office*